US008044915B2

(12) United States Patent
Honda et al.

(10) Patent No.: US 8,044,915 B2
(45) Date of Patent: Oct. 25, 2011

(54) LIQUID CRYSTAL DISPLAY APPARATUS AND METHOD OF PREVENTING MALFUNCTION IN SAME

(75) Inventors: Kenko Honda, Kawasaki (JP); Katsuyoshi Hiraki, Kawasaki (JP); Yasutake Furukoshi, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 812 days.

(21) Appl. No.: 11/058,873

(22) Filed: Feb. 16, 2005

(65) Prior Publication Data

US 2006/0082534 A1 Apr. 20, 2006

(30) Foreign Application Priority Data

Oct. 15, 2004 (JP) ..... 2004-301788

(51) Int. Cl.
*G09G 3/36* (2006.01)

(52) U.S. Cl. ..... 345/99; 345/98; 345/87

(58) Field of Classification Search ..... 345/94–100
See application file for complete search history.

(56) References Cited

U.S. PATENT DOCUMENTS 4,857,906 A * 8/1989 Conner ..... 345/97
5,701,136 A * 12/1997 Huq et al. ..... 345/100
5,986,632 A * 11/1999 Takayama et al. ..... 345/99
6,020,873 A * 2/2000 Hori ..... 345/660
2001/0028418 A1 10/2001 Ozaki et al.
2003/0098838 A1 5/2003 Minami
2004/0027323 A1* 2/2004 Tanaka et al. ..... 345/98
2004/0155851 A1* 8/2004 Morii ..... 345/99

FOREIGN PATENT DOCUMENTS

| | | |
|---|---|---|
| JP | 61-206995 | 12/1986 |
| JP | 5-264962 | 10/1993 |
| JP | 10-123563 | 5/1998 |
| JP | 2002-358051 | 12/2002 |
| TW | 565813 | 3/1990 |
| TW | 567460 | 10/2002 |
| WO | WO 95/14238 | 5/1995 |

* cited by examiner

*Primary Examiner* — Kevin M Nguyen
*Assistant Examiner* — Cory Almeida
(74) *Attorney, Agent, or Firm* — Greer, Burns & Crain, Ltd.

(57) ABSTRACT

A liquid crystal display apparatus includes a plurality of pixels arranged in matrix form including respective transistors, a plurality of gate bus lines, each of which is coupled to gates of the transistors arranged in a corresponding single row, a plurality of data bus lines, each of which is coupled to one end of channels of the transistors arranged in a corresponding single column, a gate driver configured to successively drive the plurality of gate bus lines, and a timing control circuit configured to supply to the gate driver a timing signal indicative of a start of the successive driving of the plurality of gate bus lines and to mask the timing signal for a predetermined time period following the supplying of the timing signal.

10 Claims, 9 Drawing Sheets

LIQUID CRYSTAL DISPLAY APPARATUS AND METHOD OF PREVENTING MALFUNCTION IN SAME

BACKGROUND OF THE INVENTION

1. Field of the Invention

The present invention generally relates to liquid crystal display apparatuses, and particularly relates to the driving of gate drivers in an active-matrix-type liquid crystal display apparatus.

2. Description of the Related Art

In an active-matrix-type liquid crystal display (LCD) apparatus, pixels containing thin-film transistors serving as switching devices are arranged in matrix form, with gate bus lines extending in a horizontal direction coupled to the gates of the transistors of the pixels, and data bus lines extending in a vertical direction coupled to the pixel electrodes (capacitors) of the pixels through the transistors. When data is to be displayed on the liquid crystal panel, a gate driver successively drives the gate bus lines one by one to make the transistors conductive with respect to one line at a time. Through the conductive transistors, data for one horizontal line are written from a data driver to the pixels.

FIG. 1 is a diagram showing the construction of a related-art liquid crystal display apparatus.

The liquid crystal display apparatus of FIG. 1 includes a LCD panel 10, a control circuit 11, a gate driver 12, a data driver 13, an inverter circuit 14, and a backlight 15. In the LCD panel 10, pixels including transistors Tr are arranged in matrix form. Gate bus lines GL extending from the gate driver 12 in the horizontal direction are coupled to the gates of the transistors Tr, and data bus lines DL extending from the data driver 13 in the vertical direction serve to write pixel data to the pixel electrodes through the transistors Tr.

An IF signal control circuit 11*a* of the control circuit 11 receives as incoming signals a clock signal, display data, and a display enable signal indicative of the timing of a display position. A timing controller 11*b* of the control circuit 11 counts the clock pulses of the clock signal from the start position corresponding to a positive transition of the display enable signal to determine the timing of a horizontal position, thereby generating various control signals. Further, the position where the LOW period of the display enable signal continues for more than a predetermined number of clock pulses is detected, thereby determining the position of the head of each frame.

The control signals supplied to the gate driver 12 from the timing controller 11*b* include a gate clock signal, a gate start pulse signal, etc. The gate clock signal is a synchronizing signal, and the gate bus lines are driven one by one in synchronization with the positive transitions of the gate clock signal. Namely, the transistors corresponding to one horizontal line for which the gates are turned on are shifted in the vertical direction line by line in synchronization with the positive transitions of the gate clock signal. The gate start pulse signal is a synchronizing signal that indicates the timing at which the first gate bus line is driven. This timing corresponds to the start timing of a frame. Namely, the first gate bus line (one horizontal line) of the screen is selected at the timing indicated by the gate start pulse signal for the writing of display data, and the line to which display data is written is successively shifted in the vertical direction in synchronization with the gate clock signal.

The control signals supplied to the data driver 13 from the timing controller 11*b* includes a dot clock signal, a data start signal, a latch pulse, etc. The dot clock signal is comprised of clock pulses, and display data are latched by the registers of the data driver 13 in synchronization with the positive transitions of the dot clock signal. The data start signal serves to indicate the start timings of the display data segments that are to be displayed by respective driver circuits 13*a* provided in the data driver 13. Starting at the timing indicated by the data start signal, the individual registers successively latch display data for one pixel in synchronization with the dot clock signal. The latch pulse serves to indicate the timing at which the display data stored in the registers are latched by a built-in latch. The latched display data signals are converted by DA converters into analog gray-scale signals, which are then output to the data bus lines DL as data bus line drive signals.

A DC/DC converter 11*c* of the control circuit 11 converts a direct-current power supply voltage into a direct-current voltage having a different level, which is then supplied to each circuit portion. A bias power supply circuit 11*d* of the control circuit 11 is provided with a highly precise voltage tracking function, and supplies a bias power supply voltage for determining the drive level of the LCD panel 10 to the gate driver 12 and the data driver 13. The inverter circuit 14 generates a high voltage for turning on a cold cathode-ray tube by using the direct-current power supply voltage, and supplies the generated high voltage to the backlight 15. The backlight 15 illuminates the LCD panel 10 from its backside.

[Patent Document 1] Japanese Patent Application Publication No. 5-264962

[Patent Document 2] Japanese Patent Application Publication No. 2002-358051

If the signals of various types as described above are degraded due to noise or the like, it may cause fatal malfunction. When settings are changed to switch the image resolutions of the liquid crystal display or the like, for example, the operation may fall into an abnormal state, resulting in anomalies in the display data signal, the synchronizing signals, the control signals, etc.

For example, the gate start pulse signal, which is a synchronizing signal indicative of the timing at which the first gate bus line is turn on, is normally supplied to the gate driver 12 only once during the period corresponding to the displaying of one frame. When an anomaly occurs due to a change in the settings of the liquid crystal display or the like, however, a plurality of gate start pulse signals may be generated during the period corresponding to the displaying of one frame. Alternatively, the gate start pulse signal may be prolonged so that its pulse width ends up extending over a plurality of horizontal lines.

If the plurality of gate start pulse signals are generated or the pulse width becomes excessively wide, more than one gate bus line is subjected to data writing in the LCD panel 10, resulting in an increase in the power for writing display data in the LCD panel 10. This may increase the load on the power supply circuitry such as the DC/DC converter 11*c*, causing a system shutdown, or may cause an excessive current to flow in the gate driver 12, which may destroy the circuit.

Accordingly, there is a need for a liquid crystal display apparatus which can prevent the power supply unit and other circuits from suffering a state of excessive load even when anomaly occurs in a gate start pulse.

SUMMARY OF THE INVENTION

It is a general object of the present invention to provide a liquid crystal display apparatus that substantially obviates one or more problems caused by the limitations and disadvantages of the related art.

Features and advantages of the present invention will be presented in the description which follows, and in part will become apparent from the description and the accompanying drawings, or may be learned by practice of the invention according to the teachings provided in the description. Objects as well as other features and advantages of the present invention will be realized and attained by a liquid crystal display apparatus particularly pointed out in the specification in such full, clear, concise, and exact terms as to enable a person having ordinary skill in the art to practice the invention.

To achieve these and other advantages in accordance with the purpose of the invention, the invention provides a liquid crystal display apparatus, including a plurality of pixels arranged in matrix form including respective transistors, a plurality of gate bus lines, each of which is coupled to gates of the transistors arranged in a corresponding single row, a plurality of data bus lines, each of which is coupled to one end of channels of the transistors arranged in a corresponding single column, a gate driver configured to successively drive the plurality of gate bus lines, and a timing control circuit configured to supply to the gate driver a timing signal indicative of a start of the successive driving of the plurality of gate bus lines and to mask the timing signal for a predetermined time period following the supplying of the timing signal.

According to another aspect of the present invention, a method of preventing a malfunction in a liquid crystal display apparatus including a plurality of pixels arranged in matrix form including respective transistors, a plurality of gate bus lines, each of which is coupled to gates of the transistors arranged in a corresponding single row, a plurality of data bus lines, each of which is coupled to one end of channels of the transistors arranged in a corresponding single column, and a gate driver configured to successively drive the plurality of gate bus lines includes the steps of supplying a timing signal indicative of a start of the successive driving of the plurality of gate bus lines to the gate driver, and masking the timing signal for a predetermined time period following the supplying of the timing signal.

According to at least one embodiment of the present invention, the gate start pulse signal is supplied to the gate driver as a timing signal indicative of a start of the successive driving of the plurality of gate bus lines, and a further gate start pulse signal is masked for a predetermined time period following the supplying of the gate start pulse signal. With this provision, a single gate start pulse signal per single screen period, for example, is supplied to the gate driver even if a plurality of gate start pulse signals are generated during the display period of one display screen. Further, even if the pulse width of the gate start pulse signal is changed, the masking operation starting at predetermined timing shapes the gate start pulse signal into a fixed pulse width. This makes it possible to prevent the power supply unit and other circuits from suffering a state of excessive load even when anomaly occurs in the gate start pulse.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

Figure 1:
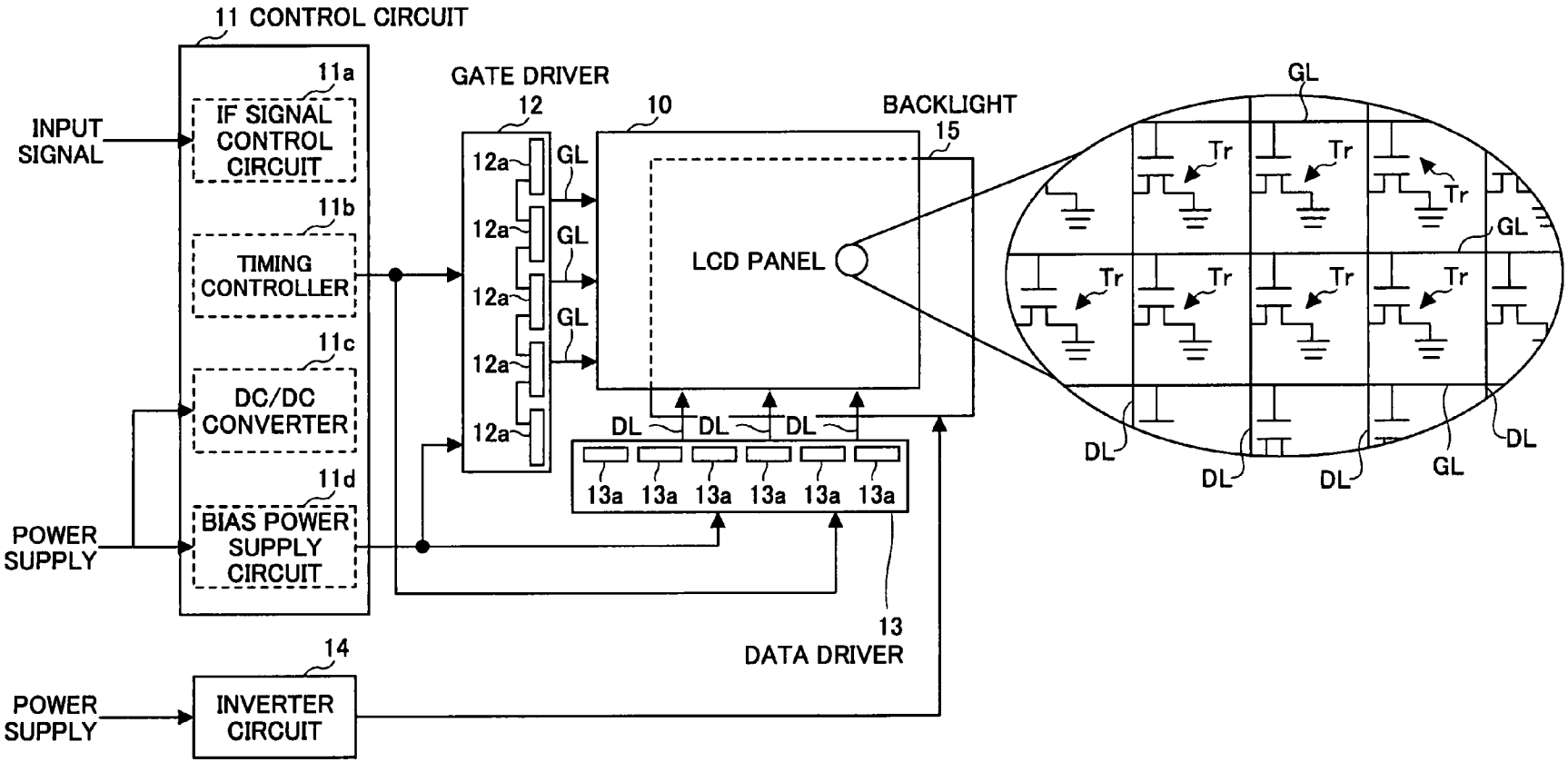
FIG. 1 is a diagram showing the construction of a related-art liquid crystal display apparatus.
Figure 2:
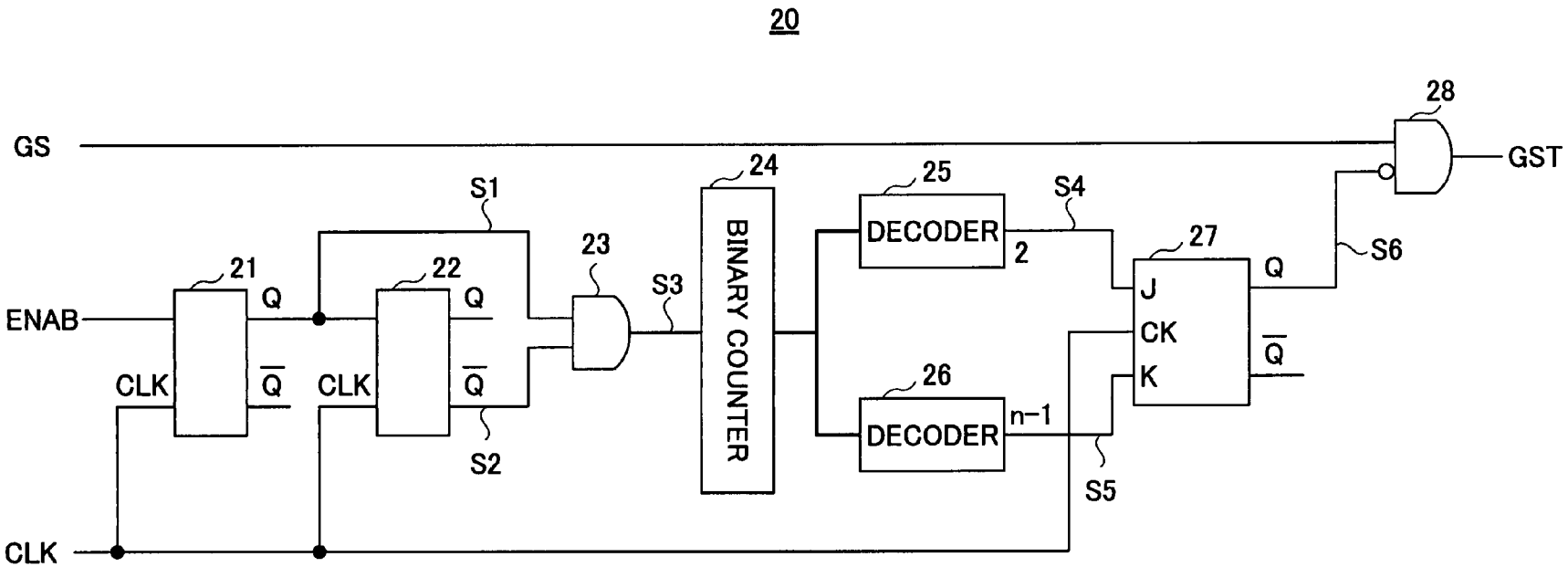
FIG. 2 is a circuit diagram showing an example of the construction of a first embodiment of a gate start pulse control circuit according to the present invention.

FIG. 2 is a circuit diagram showing an example of the construction of a first embodiment of a gate start pulse control circuit according to the present invention. A gate start pulse control circuit 20 of FIG. 2 includes D-flip-flops 21 and 22, an AND gate 23, a binary counter 24, decoders 25 and 26, a JK-flip-flop 27, and an AND gate 28 with one of the 2 inputs being a negative logic input. The gate start pulse control circuit 20 generates a gate start pulse signal GST supplied to the gate driver 12 based on a gate start pulse signal GS generated by the timing controller 11*b* shown in FIG. 1. The gate start pulse control circuit 20 may be provided as part of the timing controller 11*b*, may be provided between the control circuit 11 and the gate driver 12, or may be provided in the gate driver 12.

The D-flip-flop 21 receives as input data an enable signal ENAB indicative of the period of one horizontal line of display data, and latches the input data in synchronization with the clock signal CLK to generate a signal S1 that is equal to the enable signal ENAB delayed by one clock cycle. The D-flip-flop 22 receives the signal S1 as input data, and latches the input data in synchronization with the clock signal CLK, thereby further delaying the signal S1 by one clock cycle. The AND gate 23 performs an AND operation between the signal S1 from the D-flip-flop 21 and a signal S2 that is an inverted output /Q of the D-flip-flop 22, and supplies a result S3 to the binary counter 24. The output S3 of the AND gate 23 is a pulse signal indicative of the timing that is one clock cycle after the start of a horizontal line period of display data.

The binary counter 24 counts the pulse signal S3 output from the AND gate 23, and supplies the count to the decoders 25 and 26. The decoder 25 decodes the count supplied from the binary counter 24, and outputs a pulse signal S4 indicative of the timing of the third horizontal line of a given screen which consists of n horizontal lines. The decoder 26 decodes the count supplied from the binary counter 24, and outputs a pulse signal S5 indicative of the timing of the n-th horizontal line of the given screen which consists of the n horizontal lines.

The JK-flip-flop 27 is set by the signal S4, and is reset by the signal S5. As a result, the JK-flip-flop 27 generates a mask signal S6, which becomes HIGH at the start timing of the third horizontal line in a display screen period (at the timing that is one clock after such start timing, to be exact), and which becomes LOW at the start timing of the n-th horizontal line in the display screen period (at the timing that is one clock after such start timing, to be exact). During the HIGH period of this mask signal S6, the AND gate 28 masks the gate start pulse signal GS to generate the gate start pulse signal GST.

Figure 3:
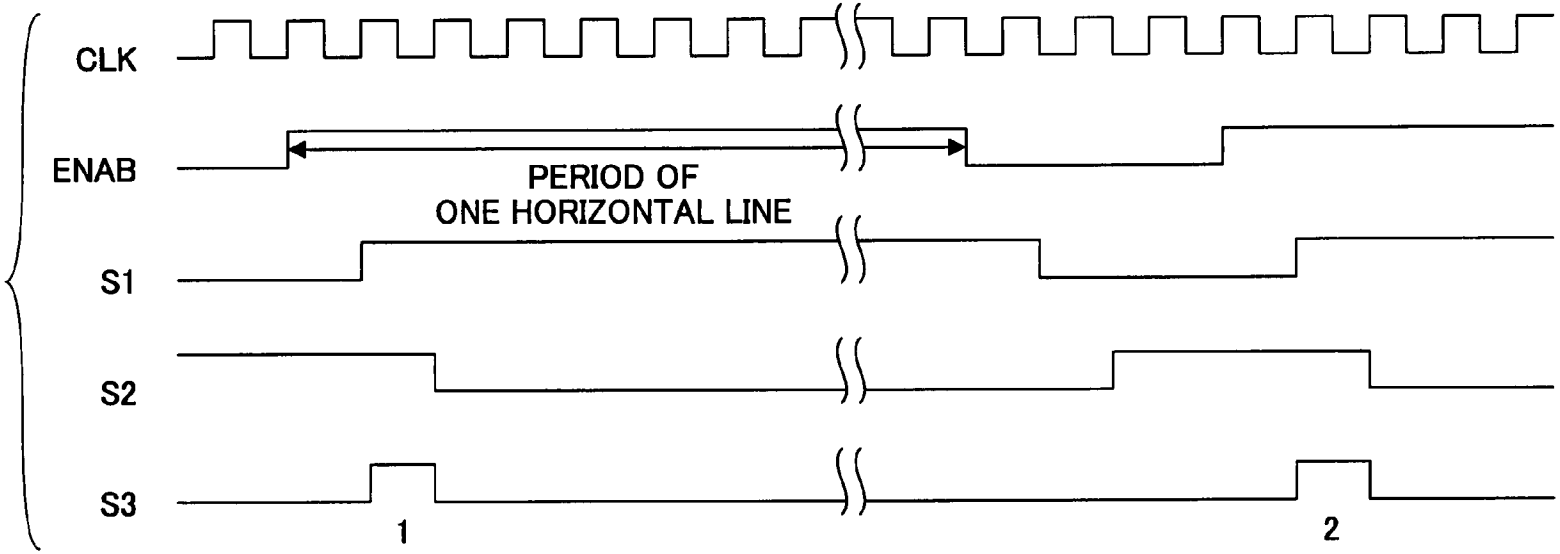
FIG. 3 is a timing chart for explaining the operation of the gate start pulse control circuit of FIG. 2.
Figure 4:
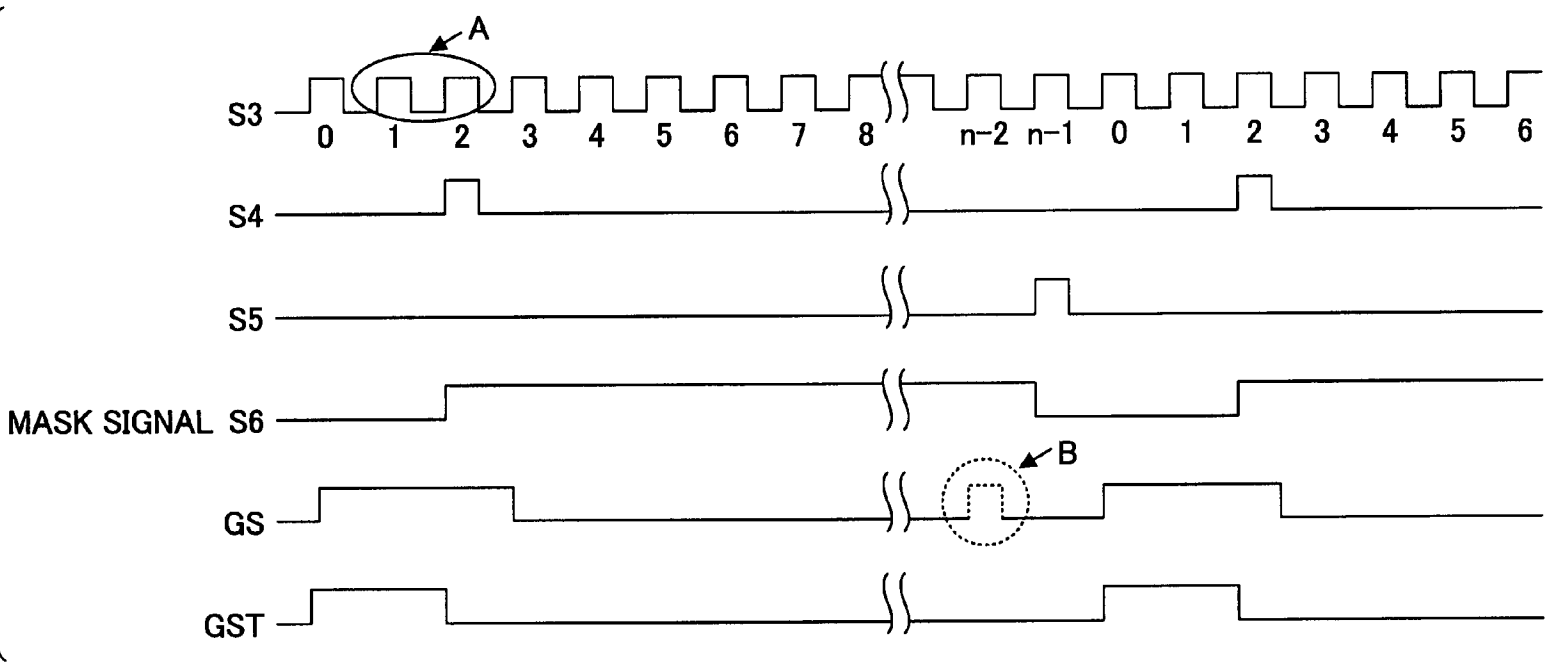
FIG. 4 is a timing chart for explaining the operation of the gate start pulse control circuit of FIG. 2.

FIG. 3 and FIG. 4 are timing charts for explaining the operation of the gate start pulse control circuit 20 of FIG. 2.

As shown in FIG. 3, the enable signal ENAB which stays HIGH for one horizontal line period is delayed by one clock cycle to become the signal S1. The signal S1 is further delayed by one clock cycle and inverted to become the signal S2. An AND operation between the signal S1 and the signal S2 generates the signal S3. The signal S3 is a pulse signal that becomes HIGH at the timing that is one clock cycle after the start of each horizontal line.

In FIG. 4, the top row illustrates the pulse signal S3 that becomes HIGH one clock cycle after the start of each horizontal line. Numbers "0" through "n−1" are assigned to the pulses of the pulse signal S3. The n horizontal lines corresponding to the n pulses "0" through "n−1" of the pulse signal S3 constitute one screen. Two pulse signals S3 pointed to as "A" by an arrow in FIG. 4 correspond to the two pulse signals S3 shown in FIG. 3. Counting the pulse signal S3 and decoding the count generate the signal S4 becoming HIGH at the timing of the third pulse (pulse #2 when the counting starts from #0) and the signal S5 becoming HIGH at the timing of the n-th pulse (pulse #n−1 when the counting starts from #0). The mask signal S6 changes to HIGH at the positive transition of the signal S4, and changes to LOW at the positive transition of the signal S5.

The gate start pulse signal GS supplied as the input is masked during the HIGH period of the mask signal S6, thereby generating the gate start pulse signal GST. Due to the masking by the mask signal S6, a single gate start pulse signal per single screen period is generated as illustrated as the gate start pulse signal GST even if a plurality of gate start pulse signals as illustrated as "B" by an arrow are generated during one display screen period by an anomaly in the gate start pulse signal GS. Further, even if the pulse width of the gate start pulse signal GS is changed, the masking operation by the mask signal starting at predetermined timing shapes the gate start pulse signal GST into a fixed pulse width.

In this manner, the first embodiment counts the number of horizontal lines to identify horizontal lines, and masks the gate start pulse signal during the period between the predetermined horizontal lines. With this provision, it is possible to supply a proper gate start pulse signal to the gate driver 12 even if anomaly occurs in the gate start pulse signal.

In the example described above, the mask signal was generated based on the enable signal ENAB. Alternatively, the mask signal may be generated in the same manner based on another control signal different from the enable signal ENAB. Such control signal suffices for this purpose if this signal is asserted a predetermined number of times during a horizontal period. The gate clock signal for shifting the gate bus lines one by one for the driving thereof or the latch pulse signal for indicating the timing at which the display data stored in the registers are latched by the built-in latch, as previously described, may be used to generate the mask signal. Further, the mask signal in the description provided above was defined by the third horizontal line and the n-th horizontal line. Alternatively, the mask signal may be defined by the fourth horizontal line and the n−1-th horizontal line. Such design change may be made as appropriate by taking into account the necessity of an masking effect.

Figure 5:
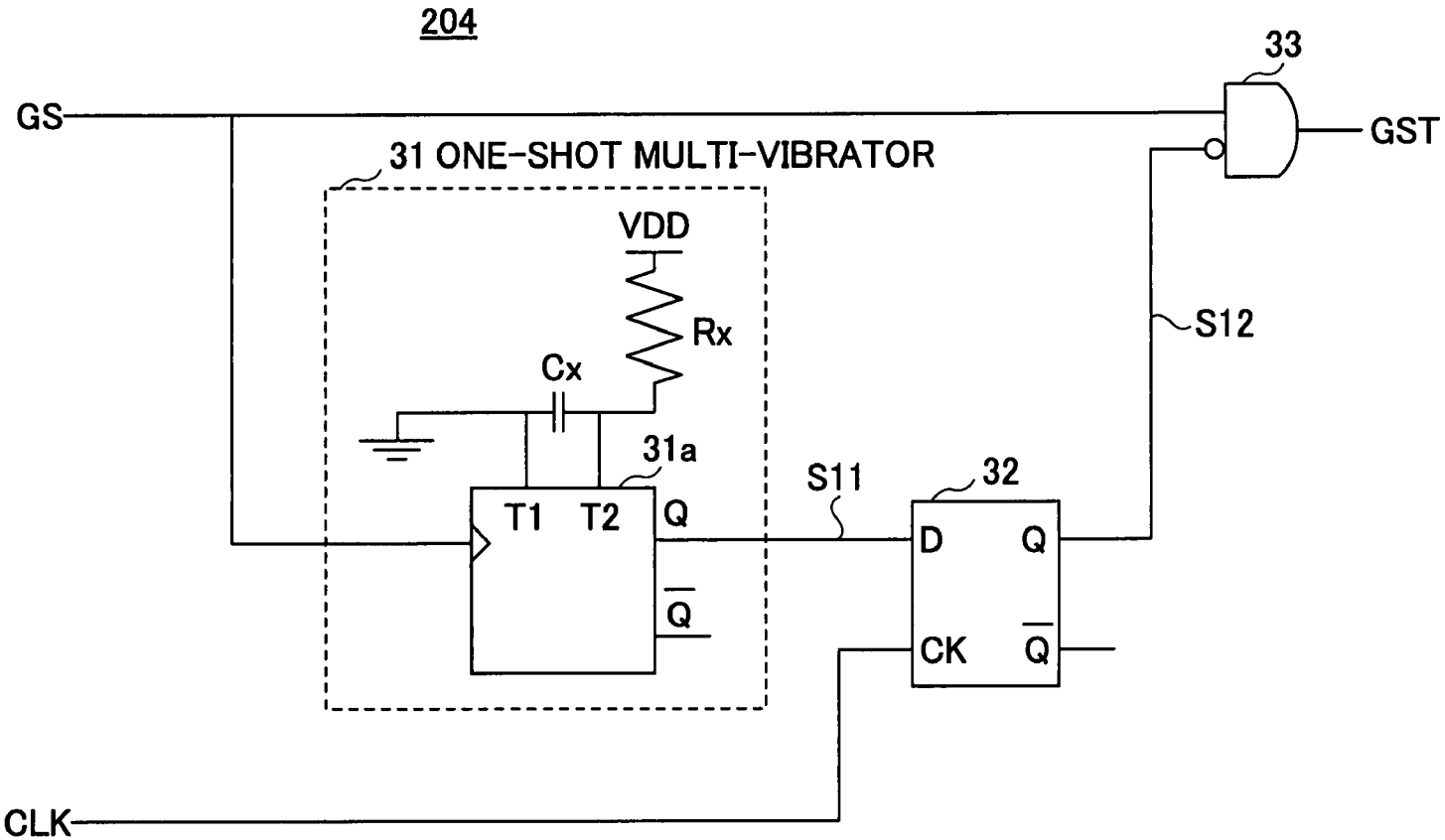
FIG. 5 is a circuit diagram showing an example of the construction of a second embodiment of the gate start pulse control circuit according to the present invention.

FIG. 5 is a circuit diagram showing an example of the construction of a second embodiment of the gate start pulse control circuit according to the present invention. A gate start pulse control circuit 20A of FIG. 5 includes a one-shot multi-vibrator 31, a D-flip-flop 32, and an AND gate 33 with one of the 2 inputs being a negative logic input. The gate start pulse control circuit 20A generates the gate start pulse signal GST supplied to the gate driver 12 based on the gate start pulse signal GS generated by the timing controller 11*b* shown in FIG. 1. The gate start pulse control circuit 20A may be provided as part of the timing controller 11*b*, may be provided between the control circuit 11 and the gate driver 12, or may be provided in the gate driver 12.

The one-shot multi-vibrator 31 includes one-shot multi-vibrator device 31*a*, a capacitor Cx, and a resistor Rx. With the capacitor Cx and resistor Rx having a proper capacitance and resistance connected to the one-shot multi-vibrator device 31*a*, the one-shot multi-vibrator 31 responds to an incoming pulse signal by generating a pulse signal staying HIGH for a predetermined duration responsive to the time constant defined by the capacitance and resistance. In the example shown in FIG. 5, the one-shot multi-vibrator 31 receives the gate start pulse signal GS as an input, and generates a pulse signal S11 that stays HIGH for a predetermined time period following the positive transition of the gate start pulse signal GS.

The D-flip-flop 32 latches the pulse signal S11 output from the one-shot multi-vibrator 31 in synchronization with the clock signal CLK, thereby generating a pulse signal S12 delayed by one clock cycle. The AND gate 33 uses the pulse signal S12 as a mask signal to mask the input gate start pulse signal GS to generate the output gate start pulse signal GST.

Figure 6:
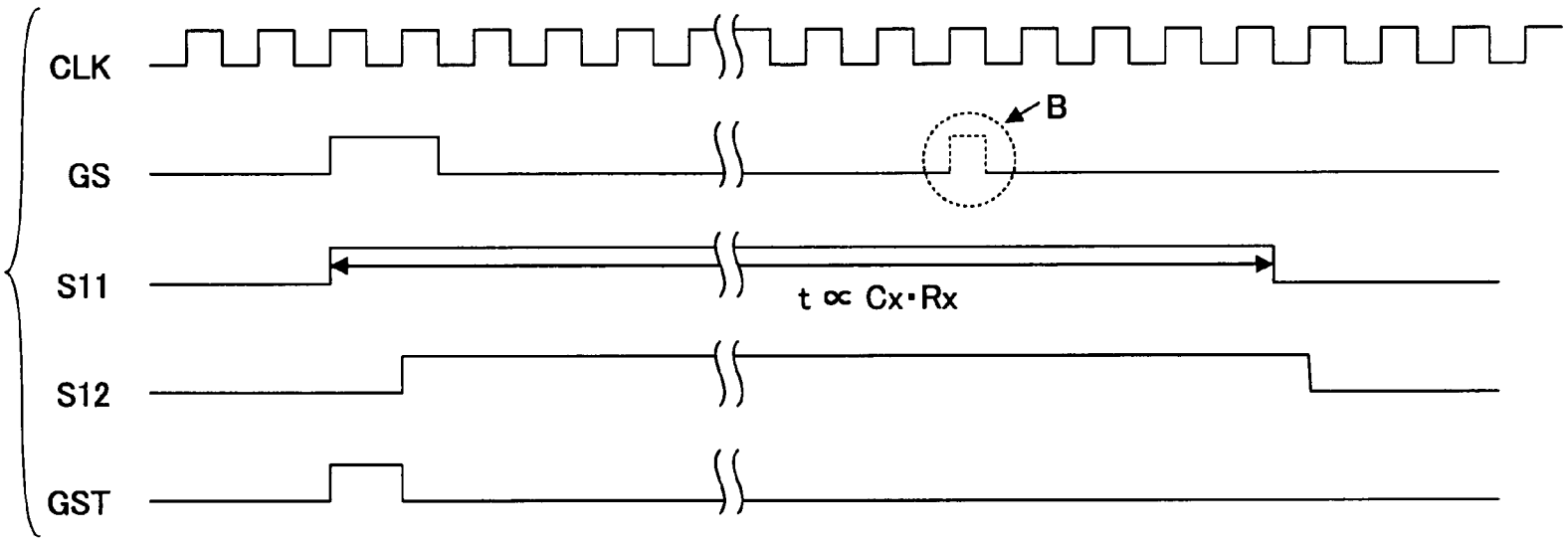
FIG. 6 is a timing chart for explaining the operation of the gate start pulse control circuit of FIG. 5.

FIG. 6 is a timing chart for explaining the operation of the gate start pulse control circuit 20A of FIG. 5.

As shown in FIG. 6, the gate start pulse signal GS is input in synchronization with the clock signal CLK. In response, the pulse signal S11 staying HIGh for the period corresponding to the time constant Cx•Rx is generated. Since the pulse signal S11 rises in response to the positive transition of the gate start pulse signal GS, this signal cannot be used as the mask signal as it is. In consideration of this, the pulse signal S11 is delayed by one clock cycle of the clock signal CLK to generate the pulse signal S12, which is then used as the mask signal. That is, the gate start pulse signal GS is masked (forced to be LOW) during the period in which the pulse signal S12 serving as the mask signal is HIGH, thereby supplying the gate start pulse signal GST to the gate driver.

A plurality of gate start pulse signals may be generated during a single display screen period due to an anomaly in the gate start pulse signal GS as shown as "B" by an arrow, for example. Even in such a case, a single gate start pulse signal per single screen is correctly generated as illustrated as the gate start pulse signal GST. Further, even if the pulse width of the gate start pulse signal GS is changed, the masking operation by the mask signal starting at predetermined timing shapes the gate start pulse signal GST into a fixed pulse width.

In this operation, the period during which the one-shot multi-vibrator 31 outputs the pulse for defining the masking period may be set to a length slightly longer than half the display period of a single display screen. This period may as well be set to almost the entire length of the display period of a single display screen. With such a setting, however, no correct display can be conducted during at least one display screen period following an abnormal signal when the one-shot multi-vibrator 31 of this embodiment generates a pulse signal by responding to the abnormal gate start pulse signal shown as "B" indicated by the arrow in FIG. 6. With the pulse width being set to a length shorter than the display period of one display screen, a recovery time necessary before correct display can be shortened. When the pulse width is set to a length slightly longer than half the display period of a single display screen, anomalies can create only two gate start pulses at maximum for one display screen. The load on the power supply circuit and the gate driver 12 is thus not so heavy.

AS shown in FIG. 1, the gate driver 12 is provided with the plurality of gate driver circuits 12*a*, each of which drives a predetermined number of gate lines GL that are situated within the area of its coverage. With the series connection of the gate driver circuits 12*a*, a shifting operation for successively scanning the gate lines in the vertical direction in synchronization with the gate clock signal propagates from a gate driver circuit 12*a* at the given stage to a gate driver circuit 12*a* at the following stage. When attention is focused on the operation of any given gate driver circuit 12*a*, all that is necessary is to prevent an abnormal gate start pulse signal from occurring during the period in which this given gate driver circuit 12*a* is driving the gate lines GL within its coverage. Accordingly, the pulse width of the pulse signal generated by the one-shot multi-vibrator 31 may be set in accordance with the time period necessary for scanning the predetermined number of gate lines GL that fall within the coverage of a signal gate driver circuit 12*a*.

In this manner, the second embodiment generates the pulse signal that stays HIGH for a predetermined fixed period, and masks the gate start pulse signal based on this generated pulse signal. With this provision, it is possible to supply a proper gate start pulse signal to the gate driver 12 even if anomaly occurs in the gate start pulse signal.

Figure 7:
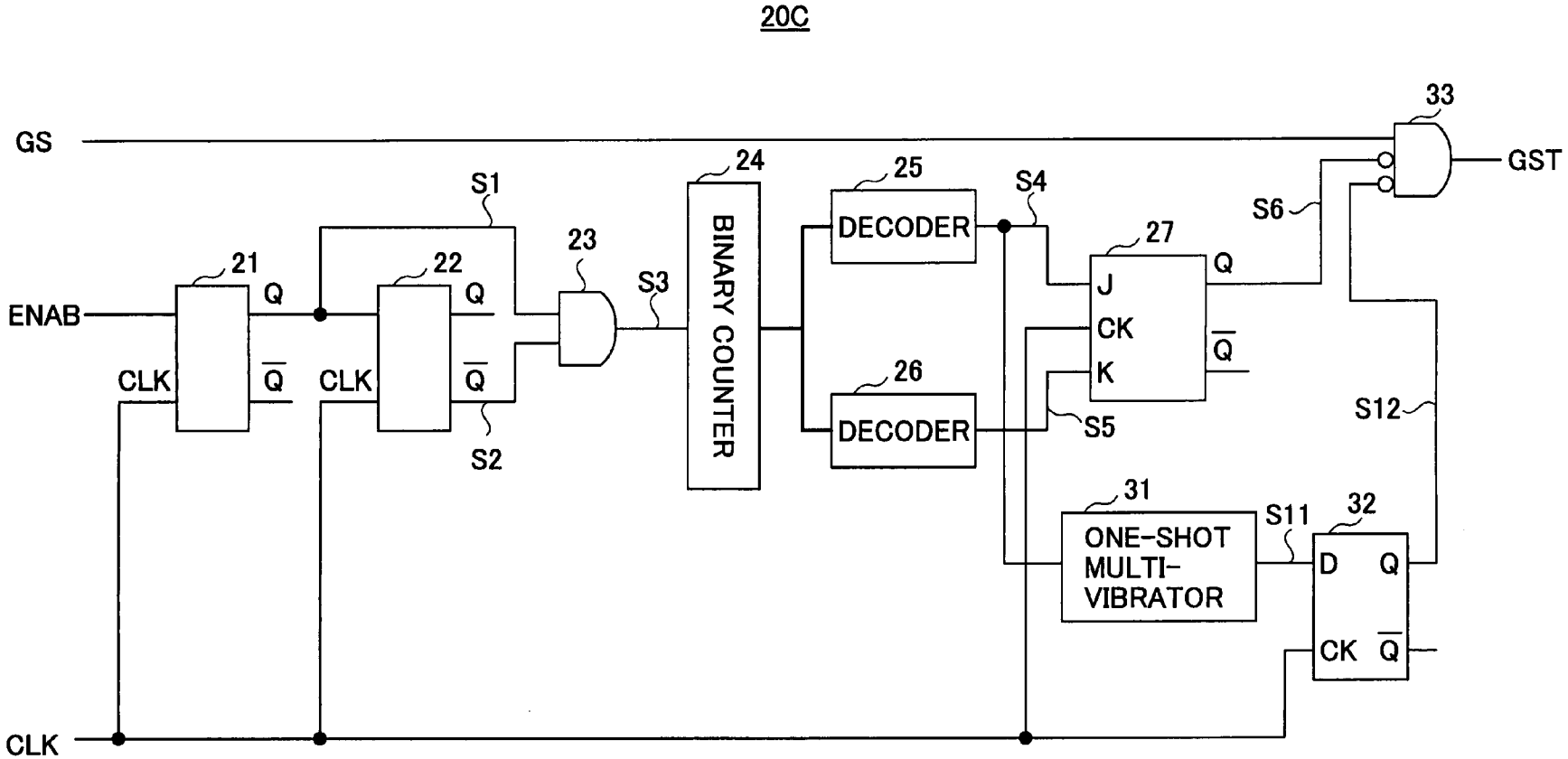
FIG. 7 is a circuit diagram showing an example of the construction of a third embodiment of the gate start pulse control circuit according to the present invention.

FIG. 7 is a circuit diagram showing an example of the construction of a third embodiment of the gate start pulse control circuit according to the present invention. The construction of FIG. 7 combines the construction of the first embodiment shown in FIG. 2 and the construction of the second embodiment shown in FIG. 5. In FIG. 7, the same elements as those of FIG. 2 or FIG. 5 are referred to by the same numerals.

A gate start pulse control circuit 20C of FIG. 7 includes the D-flip-flops 21 and 22, the AND gate 23, the binary counter 24, the decoders 25 and 26, the JK-flip-flop 27, the one-shot multi-vibrator 31, the D-flip-flop 32, and an AND gate 33 with two of the three inputs thereof being negative logic inputs. In the construction of the second embodiment shown in FIG. 5, the one-shot multi-vibrator 31 receives the gate start pulse signal GS as its input. In the third embodiment shown in FIG. 7, on the other hand, the input of the one-shot multi-vibrator 31 is coupled to the output of the decoder 25. With this provision, the mask signal S12 is generated that becomes HIGH for the predetermined duration defined by the one-shot multi-vibrator 31 following the predetermined horizontal line identified by the decoder 25, thereby masking the gate start pulse signal GS. Further, the binary counter 24 and the decoders 25 and 26 count the number of horizontal lines to identify horizontal lines, thereby generating the mask signal S6 that becomes HIGH with respect to the predetermined horizontal lines to mask the gate start pulse signal GS. This is the same as in the first embodiment.

In this manner, the third embodiment combines the first embodiment and the second embodiment. It is thus possible to process the gate start pulse signal GS by using one of the masking operations even when the other masking operation fails. This makes it possible to cope with various types of malfunctions properly, thereby achieving more reliable operations.

Figure 8:
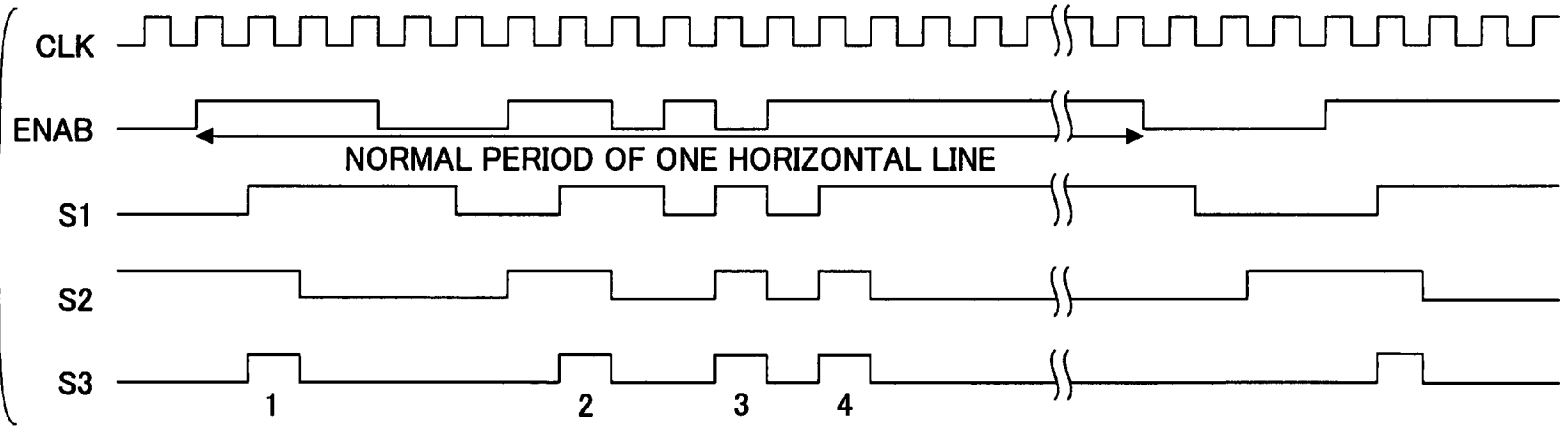
FIG. 8 is a timing chart for explaining the operation of the gate start pulse control circuit of FIG. 7.
Figure 9:
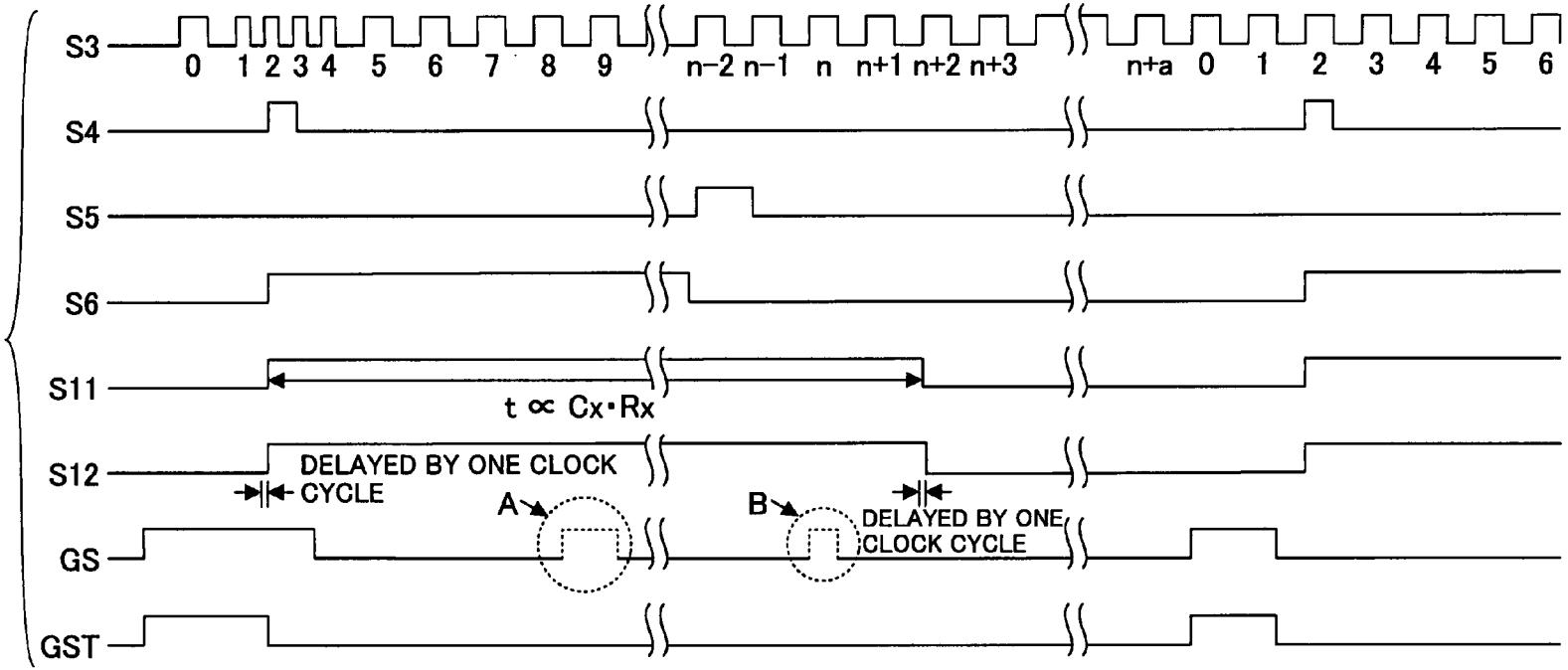
FIG. 9 is a timing chart for explaining the operation of the gate start pulse control circuit of FIG. 7.

FIG. 8 and FIG. 9 are timing charts for explaining the operation of the gate start pulse control circuit 20C of FIG. 7. This timing chart illustrates an example in which the count-based masking operation according to the first embodiment fails.

FIG. 8 shows the way the enable signal ENAB repeats changing from HIGH to LOW and from LOW to HIGH multiple times during one horizontal line period due to anomalies while the enable signal ENAB is supposed to stay HIGH for one horizontal line period. If the enable signal ENAB is normal and stays HIGH for one horizontal line period, the signals S1 through S3 behave as shown in FIG. 3. These signals, however, exhibit completely different signal waveforms in FIG. 8 because of the anomalies of the enable signal ENAB. The enable signal ENAB is delayed by one clock cycle to become the signal S1. The signal S1 is further delayed by one clock cycle and inverted to become the signal S2. An AND operation between the signal S1 and the signal S2 generates the signal S3. The signal S3 is supposed to be the pulse signal that becomes HIGH one clock cycle after the start of each horizontal line. In FIG. 8, however, the signal S3 becomes HIGH multiple times during one horizontal line.

In FIG. 9, the top row illustrates the pulse signal S3 that is supposed to become HIGH one clock cycle after the start of each horizontal line. The number of pulses in the pulse signal S3 corresponding to one display screen is n, so that only the pulses "0" through "n−1" are supposed to exist. In the example shown in FIG. 9, however, n+a+1 pulses, with numbers from #0 to #n+a, are generated because of the anomalies of the enable signal ENAB as shown in FIG. 8.

Counting the pulse signal S3 and decoding the count generate the signal S4 becoming HIGH at the timing of the third pulse (pulse #2 when the counting starts from #0) and the signal S5 becoming HIGH at the timing of the n−1-th pulse (pulse #n−2 when the counting starts from #0). The mask signal S6 changes to HIGH at the positive transition of the signal S4, and changes to LOW at the positive transition of the signal S5.

The gate start pulse signal GS supplied as the input is masked during the HIGH period of the mask signal S6. This masking operation corresponds to the masking operation of the first embodiment. In the example shown in FIG. 9, the signal S3 includes abnormal excessive pulses due to the anomalies of the enable signal ENAB. Because of the presence of these pulses, the mask signal S6 comes to an end at the timing of pulse #n−2 of the pulse signal S3 prior to the end of the driving of gate lines for one display screen that corresponds to the timing of pulse #n+a of the pulse signal S3. If this pulse signal S6 alone is used, the abnormal gate start pulse signal GS indicated as "A" by an arrow can be masked, but the abnormal gate start pulse signal GS indicated as "B" by an arrow cannot be masked.

In the construction of the third embodiment, the pulse signal S11 is generated that rises in response to the signal S4 becoming HIGH at the timing of the third pulse of the signal S3 and that stays HIGH for the period responsive to the time constant Cx•Rx. This pulse signal S11 is delayed by one clock cycle of the clock signal CLK to generate the pulse signal S12, which is then used as an additional mask signal. Namely, the gate start pulse signal GS is masked not only by use of the first mask signal S6 but also by use of the second mask signal S12. With the masking operation by use of the second mask signal S12, it is possible to mask the abnormal gate start pulse signal GS shown as "B" by the arrow. As a result, a single gate start pulse signal per single screen is correctly generated as illustrated as the gate start pulse signal GST.

Further, the present invention is not limited to these embodiments, but various variations and modifications may be made without departing from the scope of the present invention.

The present application is based on Japanese priority application No. 2004-301788 filed on Oct. 15, 2004, with the Japanese Patent Office, the entire contents of which are hereby incorporated by reference.

What is claimed is:

1. A liquid crystal display apparatus, comprising:

a plurality of pixels arranged in a matrix form including respective transistors;

a plurality of gate bus lines, each of which is coupled to gates of the transistors arranged in a corresponding single row;

a plurality of data bus lines, each of which is coupled to one end of channels of the transistors arranged in a corresponding single column;

a gate driver coupled to the plurality of gate bus lines to successively drive the gate bus lines in synchronization with a gate clock signal and a gate start pulse signal, the gate driver being configured to start the successive driving of the gate bus lines upon receiving the gate start pulse signal to drive the gate bus lines one by one in synchronization with the gate clock signal, said gate start pulse signal indicating a timing at which the gate driver starts the successive driving of the gate bus lines; and a timing control circuit configured to supply to said gate driver the gate start pulse signal;

wherein the timing control circuit generates the gate start pulse signal by masking a portion of a gate signal with a mask signal, the mask signal being produced for a predetermined time period following the supplying of the gate signal to mask any subsequent gate signal supplied to the gate driver for the predetermined time period;

the timing control circuit includes a counter for counting the predetermined time period, a first decoding device for outputting a first signal at a beginning of the predetermined time period, a second decoding device for outputting a second signal at the end of the predetermined time period, and a flip-flop device for outputting the mask signal based on the first and second signals; and the predetermined time period is longer than at least one clock cycle of the gate clock signal, said one clock cycle of the gate clock signal being equal to the driving of one gate bus line that is one horizontal line of the matrix.

2. The liquid crystal display apparatus as claimed in claim 1, wherein said timing control circuit defines the predetermined time period based on a number of the gate bus lines that are successively driven.

3. The liquid crystal display apparatus as claimed in claim 2, wherein said timing control circuit includes:

a counter configured to count synchronizing signals corresponding to the successive driving of said plurality of gate bus lines; and a circuit configured to set, in response to a count counted by said counter, the time period during which the timing signal is masked.

4. The liquid crystal display apparatus as claimed in claim 1, wherein said timing control circuit defines the predetermined time period by a timekeeping circuit configured to measure a predetermined time lapse according to a fixed parameter.

5. The liquid crystal display apparatus as claimed in claim 4, wherein the predetermined time period is set to a length longer than half a time period required for driving said plurality of gate bus lines for one display screen.

6. The liquid crystal display apparatus as claimed in claim 4, wherein said gate driver includes a plurality of gate driver devices connected in series, the predetermined time period corresponding to a time period required for successively driving the gate bus lines corresponding to one of said plurality of gate driver devices.

7. The liquid crystal display apparatus as claimed in claim 1, wherein said timing control circuit defines the predetermined time period by a number of the gate bus lines successively driven and by a timekeeping circuit configured to measure a predetermined time lapse according to a fixed parameter.

8. The liquid crystal display apparatus as claimed in claim 1, wherein said timing control circuit masks the timing signal for one of a first period and a second period, said first period being defined by the number of the gate bus lines being successively driven, and said second period being defined by said timekeeping circuit configured to measure a predetermined time lapse according to a fixed parameter.

9. A method of preventing a malfunction in a liquid crystal display apparatus including a plurality of pixels arranged in matrix including respective transistors, a plurality of gate bus lines, each of which is coupled to gates of the transistors arranged in a corresponding single row, a plurality of data bus lines, each of which is coupled to one end of channels of the transistors arranged in a corresponding single column, and a gate driver coupled to the plurality of gate bus lines to successively drive the gate bus lines in synchronization with a gate clock signal and a gate start pulse signal, the gate driver being configured to start the successive driving of the gate bus lines upon receiving the gate start pulse signal to drive the gate bus lines one by one in synchronization with the gate clock signal, said gate start pulse signal indicating a timing at which the gate driver starts the successive driving of the gate bus lines, said method comprising the steps of:

supplying a gate signal to said gate driver;

producing a mask signal for a predetermined time period following the supplying of the gate signal to mask any subsequent gate signal supplied to the gate driver for the predetermined time period, wherein the mask signal is produced by a timing control circuit including a counter for counting the predetermined time period, a first decoding device for outputting a first signal at a beginning of the predetermined time period, a second decoding device for outputting a second signal at the end of the predetermined time period, and a flip-flop device for outputting the mask signal based on the first and second signals;

and the predetermined time period is longer than at least one clock cycle of the gate clock signal, said one clock cycle of the gate clock signal being equal to the driving of one gate bus line that is one horizontal line of the matrix;

generating the gate start pulse signal by masking a portion of the gate signal with the mask signal for the predetermined time period; and supplying the gate start pulse signal to said gate driver.

10. A driver circuit for driving a liquid crystal display having gate bus lines, comprising:

a gate driver coupled to the gate bus lines to successively drive said gate bus lines in synchronization with a gate clock signal and a gate start pulse signal, the gate driver being configured to start the successive driving of the gate bus lines upon receiving the gate start pulse signal to drive the gate bus lines one by one in synchronization with the gate clock signal; said gate start pulse signal indicating a timing at which the gate driver starts the successive driving of the gate bus lines; and a timing control circuit configured to supply to said gate driver the timing signal;

wherein the timing control circuit generates the gate start pulse signal by masking a portion of a gate signal with a mask signal, the mask signal being produced for a predetermined time period following the supplying of the gate signal to the gate driver to mask any subsequent gate signal supplied to the gate driver for the predetermined time period;

the timing control circuit includes a counter for counting the predetermined time period, a first decoding device for outputting a first signal at a beginning of the predetermined time period, a second decoding device for outputting a second signal at the end of the predetermined time period, and a flip-flop device for outputting the mask signal based on the first and second signals; and the predetermined time period is longer than at least one clock cycle of the gate clock signal, said one clock cycle of the gate clock signal being equal to the driving of one gate bus line that is one horizontal line of the liquid crystal display.

* * * * *